United States Patent [19]

Backus

[11] Patent Number: 4,922,728

[45] Date of Patent: May 8, 1990

[54] HEATER PLATE ASSEMBLY

[75] Inventor: Robert J. Backus, Dewitt, N.Y.

[73] Assignee: Carrier Corporation, Syracuse, N.Y.

[21] Appl. No.: 344,791

[22] Filed: Apr. 28, 1989

[51] Int. Cl.[5] ..... F25B 47/00

[52] U.S. Cl. ..... 62/278; 62/239

[58] Field of Search ..... 62/151, 277, 278, 239

[56] References Cited

U.S. PATENT DOCUMENTS

| | | | |
|---|---|---|---|
| 2,759,339 | 8/1956 | Kundert | 62/278 |
| 3,108,450 | 10/1963 | Crotser | 62/278 X |
| 3,664,150 | 5/1972 | Patterson | 62/278 X |
| 4,646,539 | 3/1987 | Taylor | 62/278 |

*Primary Examiner*—Lloyd L. King

*Attorney, Agent, or Firm*—David J. Zobkiw

[57] ABSTRACT

To prevent defrost melt from refreezing during a defrost cycle, the hot gas bypass line is branched to heat the metal plate across which the defrost melt flows as well as the drain pan.

3 Claims, 2 Drawing Sheets

HEATER PLATE ASSEMBLY

BACKGROUND OF THE INVENTION

Some applications of trailer refrigeration units have special problems associated with defrost. A trailer that is used to transport and deliver ice cream, for example, has special problems. It is desirable to maintain the ice cream at −20° F., or below. Even if the product is loaded at the correct temperature into a pre-cooled trailer, water vapor in the air, which enters the trailer during the loading process, will freeze on the fins of the evaporator coil. In addition, each time the trailer door is opened during a delivery, warm, moist air will enter the trailer adding to the amount of ice forming on the evaporator coil. Frequent deliveries on a hot humid day can result in many defrost cycles, with a considerable amount of water being melted off the evaporator coil.

Because the surface of the evaporator pod beneath the coil is very cold, the defrost melt dripping off the coil fins refreezes on the pod before it can run down into the drain pan. The resulting ice can build up to the point where it begins to restrict the flow of air returning to the coil. The ice can also sublimate to vapor during the cooling cycle, where it immediately refreezes back on the coil, requiring more defrosts.

In order to maintain load temperature and product quality, it is desirable to keep the length and frequency of the defrost cycles to a minimum. In the past, a hot gas line has been located in the drain pan to keep the drain holes free of ice. While this does keep the drain pan free of ice, it does nothing to prevent ice from building up on the evaporator pod

SUMMARY OF THE INVENTION

During the defrost cycle, hot gas from the compressor is passed through the evaporator coil of a transport refrigeration unit to melt the ice which has formed on the fins of the coil. The hot gas bypass line, which is opened during defrost, runs along the drain pan prior to being connected to the evaporator coil. A parallel branch of the hot gas bypass line is formed in a serpentine pattern and extends across a metal plate on the pod. The parallel branch is sized to provide just enough heat to the metal plate to keep the defrost melt from refreezing before it can run into the drain pan, while not materially increasing the duration of the defrost cycle.

It is an object of this invention to prevent the refreezing of the defrost melt.

It is another object of this invention to insure the removal of the defrost melt from a refrigerated space.

It is a further object of this invention to eliminate defrost cycles that are too frequent. These objects, and others as will become apparent hereinafter, are accomplished by the present invention.

Basically, hot gas from the compressor is divided into two parallel flows. The major branch passes through the drain pan tube and the minor branch passes through a serpentine tube located on a metal plate on the evaporator pod sloping into the drain pan. The two branch flows recombine and flow through the evaporator coil thereby defrosting the evaporator coil and keeping the defrost melt liquid until it passes from the refrigerated space.

BRIEF DESCRIPTION OF THE DRAWINGS

For a further understanding of the present invention, reference should now be made to the following detailed description thereof taken in conjunction with the accompanying drawings wherein.

DESCRIPTION OF THE PREFERRED EMBODIMENT

Figure 1:
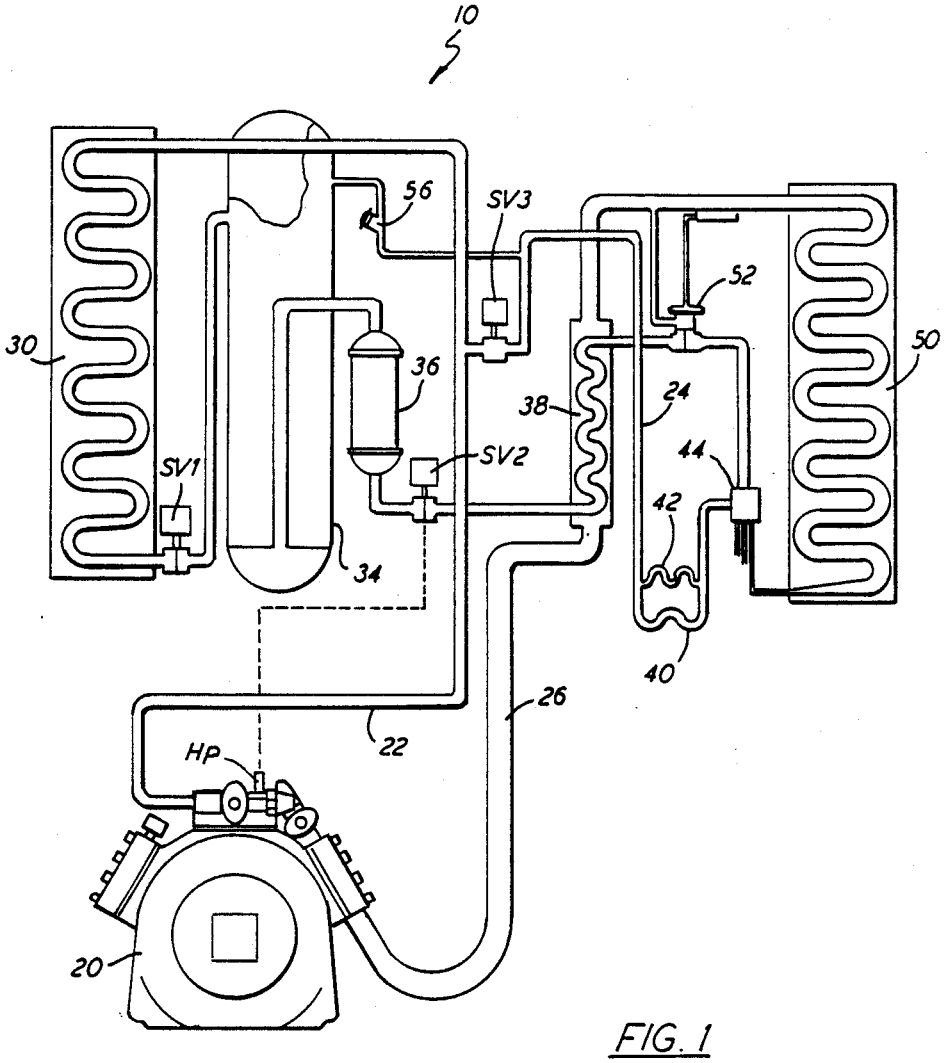
FIG. 1 is a schematic representation of a diesel nosemount refrigeration unit employing the present invention.
Figure 2:
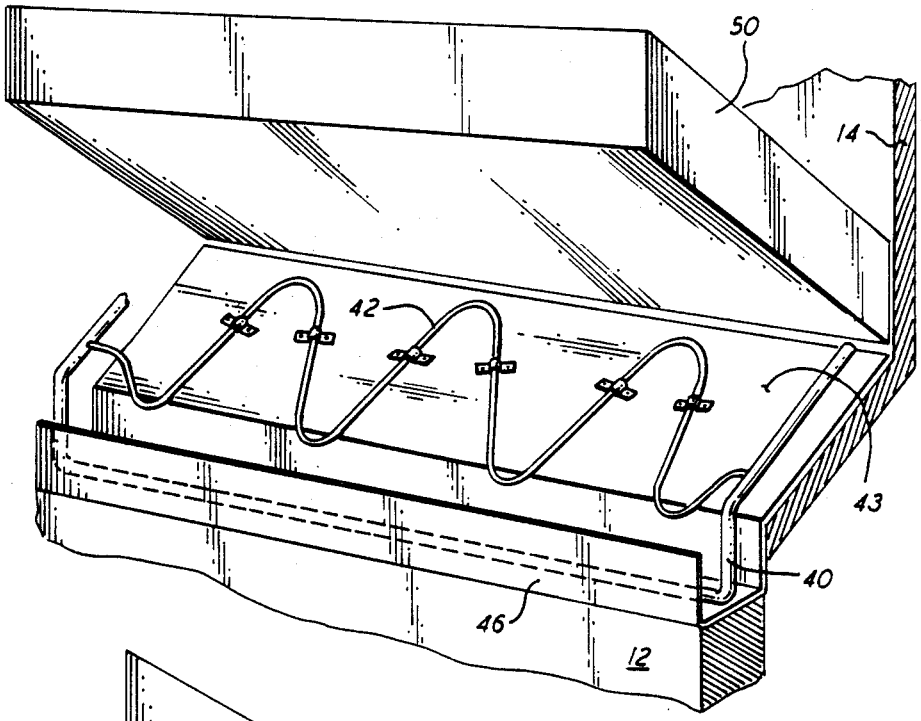
FIG. 2 is a pictorial view of the heater plate assembly.
Figure 3:
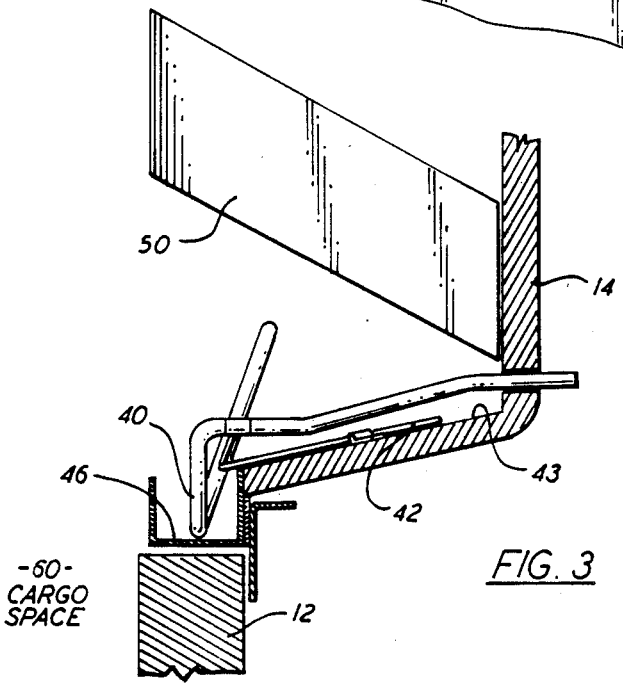
FIG. 3 is a side view of the heater plate assembly of FIG. 2.

In FIG. 1, the numeral 10 generally designates a diesel nosemount refrigeration unit which is mounted on truck trailer 12 and includes a pod 14 which forms a thermal barrier between the cargo space 60 and ambient as best shown in FIGS. 2 and 3. Refrigeration unit 10 includes compressor 20, discharge line 22, condenser 30, liquid receiver 34, filter-drier 36, heat exchanger 38, drain pan heater 40, metal plate heater 42, distributor 44, evaporator 50 and thermal expansion valve 52. Additionally, refrigeration unit 10 includes normally open solenoid valve SV-1 and normally closed solenoid valves SV-2 and 3, as well as bypass check valve 56.

In the cooling cycle, solenoid valves SV-1 and 2 and expansion valve 52 will be open while solenoid valve SV-3 and bypass check valve 56 will be closed. When refrigerant vapor is raised to a high temperature in reciprocating compressor 20, the mechanical energy consumed is added to the refrigerant in the form of heat and pressure. This heat, the heat of compression, is the heat source for the heating and defrost modes of operation. When the solid state temperature controller (not illustrated) calls for heat, SV-1, the condenser pressure control solenoid valve is energized and closed and SV-3, the hot gas solenoid, is energized and open. Liquid refrigerant will begin to fill the condenser 30 and hot refrigerant gas will pass directly to the evaporator 50 via hot gas line 24 which divides into two parallel paths 40 and 42 defining the drain pan and metal plate heaters, respectively, and recombines and flows into distributor 44 which divides the flow so as to supply each circuit of evaporator 50. During heating, SV-2, the liquid line solenoid, is controlled only by the head pressure control switch HP. If the head pressure is below a predetermined fixed value, eg. 220 psig, HP will remain closed, which in turn supplies potential to SV-2, keeping it open. This allows additional liquid refrigerant to be metered into the evaporator 50 via thermal expansion valve 52 for increased heating capacity.

SV-2 will remain open until the head pressure reaches the predetermined fixed value. At this time HP will open, removing potential from SV-2 and allowing it to close. SV-2 will remain closed until the discharge pressure drops to a predetermined fixed value, eg. 180 psig, at which time HP will reclose, energizing and opening SV-2 for additional capacity. Thus, SV-2 can be either open or closed during heating and defrost, depending upon the operating head pressure.

Hot gas from line 24 is used to pressurize receiver 34 during heating and defrost to push the refrigerant out when SV-2 opens. Bypass check valve 56 allows flow into the receiver from line 24 during heating and defrost but prevents refrigerant leakage to the evaporator 50 during the cooling mode.

Other than duration and purpose, the only difference in the operation of the heating and defrosting cycles is the position of a damper (not illustrated). The damper is closed in the defrost cycle to prevent heated air from circulating into the cargo space 60.

In operation during the defrost cycle, hot high pressure refrigerant vapor is discharged from compressor 20 into discharge line 22. The hot, high pressure refrigerant vapor passes from discharge line 22 to hot gas line 24 which divides into two parallel paths 40 and 42 defining the drain pan and metal plate heaters, respectively, and recombines and flows into distributor 44 which divides the flow such that each of the circuits of evaporator coil 50 are subjected to defrost. In passing through the evaporator coil 50, the hot, high pressure refrigerant vapor becomes cooled and drops in pressure and is returned to compressor 20 via suction line 26

Referring now to FIGS. 2 and 3, it will be noted that evaporator coil 50 and heater plate 43 make a sideways V. Thus, when the refrigeration unit 10 is in the defrost cycle, the hot refrigerant gas passing through evaporator coil 50 tends to melt any ice which has formed on evaporator coil 50. The defrost melt drips onto heater plate 43 and/or flows towards the apex of the V and then onto heater plate 43. If heater plate 43 was not heated by hot refrigerant gas passing through metal plate heater 42, the defrost melt reaching heater plate 43 could refreeze since it is at 32° F. and heater plate 43 may be at −20° F., or lower. However, with hot refrigerant vapor flowing through metal plate heater 42, the defrost melt is not able to refreeze on heater plate 43. It will be noted in FIGS. 2 and 3 that the metal plate heater 42 extends beyond the lower edge of heater plate 43 to permit the free flow of defrost melt into drain pan 46. Drain pan heater 40 heats drain pan 46 so that the defrost melt remains liquid and drains from drain pan 46 to ambient in a conventional manner.

Although a preferred embodiment of the present invention has been illustrated and described, other changes will occur to those skilled in the art. It is therefore intended that the present invention is to be limited only by the scope of the appended claims.

What is claimed is:

1. In a refrigeration system operable in a defrost mode having an evaporator, a drain pan and a sloping surface beneath said evaporator and leading to said drain pan, a defrost circuit comprising:

a compressor having a suction line and a discharge line;

a hot gas line connected to said discharge line and said evaporator and having a pair of branches;

said evaporator being connected to said suction line;

a first one of said pair of branches serving to heat said drain pan during a defrost cycle;

a second one of said pair of branches serving to heat said sloping surface whereby defrost melt is prevented from freezing on said sloping surface during defrost.

2. The refrigeration system of claim 1 wherein said refrigeration system is a transport refrigeration system connected to a cargo space and said sloping surface and drain pan are exposed to said cargo space.

3. The refrigeration system of claim 1 wherein said sloping surface is metal and said second one of said pair of branches is in a serpentine pattern or said sloping surface and extends beyond said sloping surface a sufficient distance to prevent damming of said defrost melt.

* * * * *